US005220384A

United States Patent [19]

Landa et al.

[11] Patent Number: 5,220,384

[45] Date of Patent: Jun. 15, 1993

[54] LIQUID DEVELOPER BASED IMAGING MACHINE USING A DEVELOPING ELECTRODE

[75] Inventors: Benzion Landa, Edmonton, Canada; Yakov Krumberg, Rehovot; Hani Younes, Ara Village, both of Israel

[73] Assignee: Spectrum Sciences B.V., Rotterdam, Netherlands

[21] Appl. No.: 375,348

[22] Filed: Jul. 3, 1989

Related U.S. Application Data

[63] Continuation of Ser. No. 273,830, Nov. 21, 1988, abandoned.

[51] Int. Cl.[5] ..... G03G 15/10

[52] U.S. Cl. ..... 355/256; 118/647; 355/257

[58] Field of Search ..... 355/257, 264, 256, 261, 355/262, 263, 265; 430/103, 117; 118/647, 659, 662

[56] References Cited

U.S. PATENT DOCUMENTS

| | | | |
|---|---|---|---|
| 3,758,204 | 9/1973 | Mochizuki | 355/264 |
| 3,836,361 | 9/1974 | Metcalfe et al. | 430/103 |
| 3,861,861 | 1/1975 | Thettu | 355/283 X |
| 3,900,003 | 8/1975 | Sato et al. . | |
| 4,035,071 | 7/1977 | Miyakawa et al. | 355/256 X |
| 4,041,217 | 8/1977 | Collins | 429/112 |
| 4,168,329 | 9/1979 | Miyakawa et al. | 427/8 |
| 4,286,039 | 8/1981 | Landa et al. | 430/119 |
| 4,329,565 | 5/1982 | Namiki et al. | 355/290 X |
| 4,411,976 | 10/1983 | Landa et al. | 430/114 |
| 4,423,134 | 12/1983 | Miyakawa et al. | 430/103 |
| 4,501,482 | 2/1985 | Stryjewski | 355/290 |
| 4,727,394 | 2/1988 | Bov, Jr. et al. . | |
| 4,763,158 | 8/1988 | Schleuter, Jr. | 355/284 |
| 4,794,651 | 12/1988 | Landa et al. | 430/110 |
| 4,894,686 | 1/1990 | Bujese | 355/271 |

FOREIGN PATENT DOCUMENTS

| | | | |
|---|---|---|---|
| 0939206 | 1/1974 | Canada | 118/647 |
| 0138664 | 8/1982 | Japan | 355/264 |
| 1414335 | 11/1975 | United Kingdom . | |
| 2103516 | 2/1983 | United Kingdom | 355/256 |

OTHER PUBLICATIONS

Fink et al., Standard Handbook for Electrical Engineers, 1978, pp. 4–206.

*Primary Examiner*—A. T. Grimley
*Assistant Examiner*—Robert Beatty
*Attorney, Agent, or Firm*—Sandler, Greenblum & Bernstein

[57] ABSTRACT

A liquid toner based imaging machine includes a movable photoconductive member carrying an electrostatic latent image. A developing station contains a source of toner liquid that includes charged toner particles. The station is operatively associated with the carrier for contacting the carrier with the liquid for which develops the latent image by effecting the transfer of toner particles to the image. The developing station includes a developer electrode charged to a voltage intermediate voltages on the carrier representative of background and information of the image for attracting toner particles to an elemental area of the carrier when the electric field between the carrier and the electrode is directed towards the elemental area. The deposition of toner particles on the surface of the electrode is inhibited during development of the image by coating the surface of the electrode facing the carrier with a polymer material having a conductivity increasing additive.

19 Claims, 1 Drawing Sheet

LIQUID DEVELOPER BASED IMAGING MACHINE USING A DEVELOPING ELECTRODE

RELATED APPLICATIONS

This application is a continuing application of application Ser. No. 273,830 filed Nov. 21, 1988 now abandoned. The subject matter in this application is related to the subject matter in copending application Ser. No. 273,831 filed Nov. 21, 1988.

TECHNICAL FIELD

This invention relates to a liquid toner based imaging machine and to a developer electrode therefor.

BACKGROUND OF THE INVENTION

Liquid toner based copying machines are described in U.S. Pat. Nos. 4,286,039, 4,411,976, 4,727,394, and 3,900,003, the disclosures of which are hereby incorporated by reference. In these copying machines, an electrostatic latent image is formed on a photoconductive carrier movable into proximity with a developer electrode held at a voltage intermediate the voltages on the carrier representative of background and information portions of the image. Liquid toner, comprising a dielectric carrier liquid containing charged toner particles, is applied between the photoconductive carrier and the developer electrode. The toner particles, being charged, are drawn to and plate out on information portions of the carrier. In regions on the carrier associated with background, toner particles are drawn toward and tend to plate out on the developer electrode as the regions on the carrier associated with background portions of the image move past the electrode. After development of the image, the carrier moves to a transfer station where the developed image is transferred to a receiving sheet. Thereafter, the carrier is cleared of any residual toner particles, charged to a high voltage at a charging station, and moved to an image station where another image is optically projected onto the carrier. The process described above then repeats.

Substantial amounts of toner particles are likely to remain on the developer electrode from a preceding cycle of operations. Such particles will adhere to the developer electrode when the product of the force attracting the particles to the electrode and the coefficient of friction of the particles on the surface of the electrode is greater than the shear force caused by the flow of toner liquid over the electrode, if such flow is present at all. From a practical standpoint, it is well known that toner particles adhere to the developer electrode and must be removed if good copies of images on the carrier are to be obtained.

U.S. Pat. No. 4,168,329 discloses removal of toner particles from a developer electrode by pulsing the electrode with a reverse bias subsequent to development of the image, i.e., during an inter-image interval of operation of the machine. This procedure cleans toner particles from the electrode but results in the deposition of the particles onto the carrier necessitating their removal by a further processing operation. This technique is also disclosed in U.S. Pat. Nos. 4,041,217, 4,168,329, and 4,423,134.

Other techniques are also known, such as utilizing a conductive roller for the developer electrode (U.S. Pat. No. 4,454,833). Toner particles deposited on the roller can be removed by mechanical means, for example, which contact that surface of the roller outside the development region. Other techniques involve placing a high charge on a transverse band on the carrier during the inter-image interval, and passing the charged band over the electrode to deplate toner particles which adhere to the band. This approach, however, also requires further processing of the carrier before the next cycle of operations can begin.

Finally, as disclosed in GB 1,414,335, the developer electrode may be coated with a polymer which inhibits adhesion of toner particles thereto. Polymers disclosed in this patent include a silicone resin, a polytetrafluoroethylene, a polyurethane, a polypropylene, a polyvinyl chloride, a polycarbonate, and a cellulose acetate. According to the patent, the coating has a thickness in the range of from 1–100 microns.

Experiments were performed by the inventors of the present invention to determine if release coatings on developer electrodes have an effect on the image quality. These experiments have established that an electrode coated with a dielectric, such as vinyl polydimethylsiloxane polymer containing a noble metal complex as a catalyst, and a hydrogen functional polymethylsiloxane polymer with thickness of 20 or 40 microns or a polytetrafluoroethylene of 50 micron thicknesses, adversely affect image development. The effect on image development is best demonstrated by producing copies which are uniformly dark. In such case, the optical density of large image areas decrease significantly in the process direction when a development electrode coated in the manner described above is used. This effect is more pronounced for thicker dielectric coatings. This effect is not observed when an uncoated electrode is employed, and is more pronounced for thicker coatings. From this standpoint, coated electrodes known in the prior art and described in GB 1,414,335 are not practical for images which contain large printed areas.

While the techniques of the prior art have been reasonably successful in some respects, all but the approach taken in GB 1,414,335 include a residual cleanup process to remove toner particles that are deplated from the developer electrode before the next copying cycle is carried out. It has also been found that when toners of the type described in example 1 of U.S. Pat. No. 4,794,651 are used with coated developers of the type known in the art, there is a tendency to form a deposit on the developer despite the coating.

It is therefore an object of the present invention to provide a new and improved liquid toner based electrostatic imaging machine, and a developer electrode therefor, which eliminates, or substantially reduces, the above-mentioned deficiencies of the prior art.

BRIEF DESCRIPTION OF INVENTION

The present invention provides a liquid toner based imaging machine comprising a movable photoconductive carrier, means for producing an electrostatic latent image on the carrier, and a developing station containing a source of toner liquid that includes charged toner particles. The developing station is operatively associated with the carrier for contacting the same with toner liquid thereby developing the latent image by effecting the transfer of toner particles carried by the liquid to the image.

The developing station includes a developer electrode held at a voltage intermediate voltages on the carrier representative of background and information portions of the image. As the carrier containing background portions of the image moves relative to an elemental area on the electrode, the resultant electric field is directed toward the elemental area. As a consequence, charged toner particles in the vicinity are attracted to the elemental area. According to the present invention, means are provided for inhibiting the deposition of toner particles on the surface of the electrode during development of the image. Such means for inhibiting deposition of toner particles on the surface of the electrode includes a coating on the surface of the electrode facing the carrier of dielectric material incapable of maintaining a surface charge with a polarity opposite to that of the charge on the toner particles. When the toner is negatively charged, a suitable material is a fluorosilicone polymer, e.g., Dow Corning 730 Solvent Resistant Sealant. In such case the preferred coating thickness is about 20 microns.

Alternatively, coating the developer electrode with fluorosilicone surfactants such as Zonyl (DuPont) has been effective in inhibiting plating out of toner particles, but this expedient inhibits plating-out of toner particles for only a limited period of time.

Where the toner is positively charged, or as an alternative to the use of fluorosilicone polymer for the case of negative charged toner particles, the release material should be slightly conductive. The preferred way in which to achieve this conductivity is to load the fluorosilicone polymer with an additive of conductive material, such as carbon black. Of considerable importance to the success of this embodiment of the invention is the physical size of the particles of carbon black. What is essential is that the size of the carbon black particles be small enough so that the material is uniformly distributed in the polymer without any significant gaps in the conductivity on the surface of the coating. A preferred additive is Catafor CA100. The preferred amount of conductive material to fluorosilicone polymer is less than about 1% by weight. The preferred range of the additive is between about 0.5% to about 0.75% by weight.

BRIEF DESCRIPTION OF THE DRAWINGS

Non-limiting embodiments of the present invention are disclosed in the accompanying drawings wherein.

DETAILED DESCRIPTION

Figure 1:
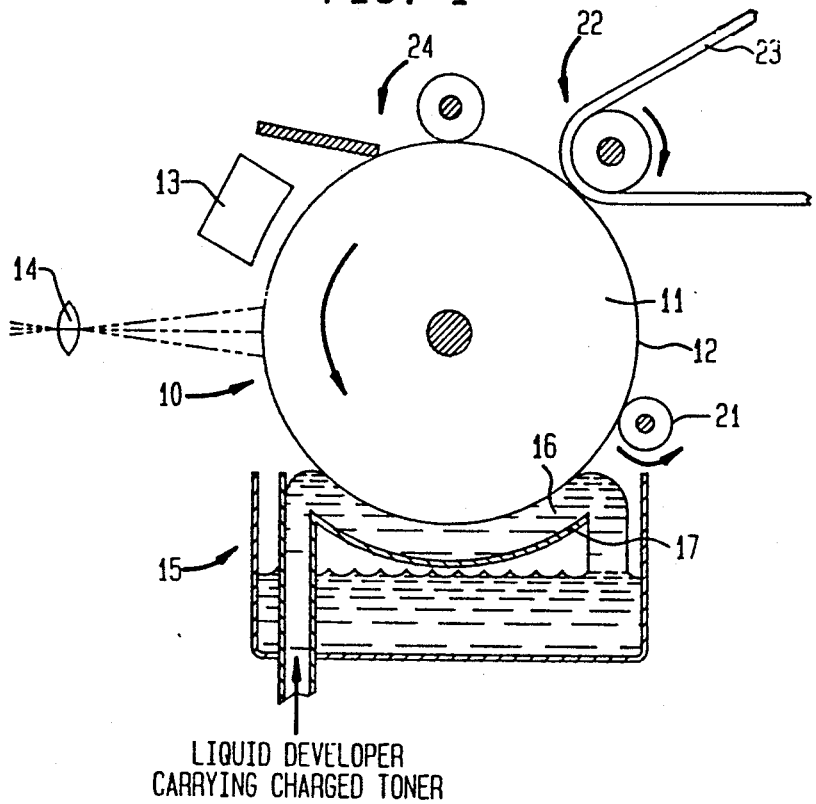
FIG. 1 is a schematic side view representation of a liquid toner based electrophotographic copy machine according to the present invention utilizing a photosensitive carrier in the form of a drum.

Referring now to FIG. 1, reference numeral 10 designates a liquid toner based electrophotographic copying machine according to the present invention. The machine includes a movable photoconductive carrier in the form of drum 11 that is rotatably mounted on a support (not shown). Peripheral surface 12 of the drum is photosensitive and capable of being charged to a high voltage at a charging station by discharge device 13 as the drum rotates past the device. Downstream of device 13 is an imaging station at which an optical image is projected onto surface 12 through lens 14 to produce on the surface 12 a latent electrostatic image. Information in the image is associated with highly charged elemental areas on the surface; and background in the image is associated with less charged elemental areas.

After the electrostatic image is produced on the surface of the drum, further rotation brings the surface containing the latent image to developing station 15 where a supply of toner liquid 16 is placed in contact with the surface of the drum. Liquid 16 contains either positively or negatively charged toner particles (not shown) and is kept in contact with the surface of the drum by developer electrode 17 at station 15 which is closely spaced to the drum surface. Electrode 17 is held at a voltage intermediate the voltages on surface 12 of the drum associated with information and with background in the image. Typically, the surface of the drum is charged to a potential of about 1000 V. with the result that elemental areas on the surface of the drum containing information in the image may be charged to a potential as high as about 1000 V., and elemental areas containing background may be charged to a potential as low as about 100 V. In such case, developer electrode would be held at about 300 V.

A preferred toner for use with the present invention is that produced in accordance with example 1 of U.S. Pat. No. 4,794,651, the disclosure of which is included herein by reference. The present invention will also be operative with a variety of other liquid toners.

Figure 2:
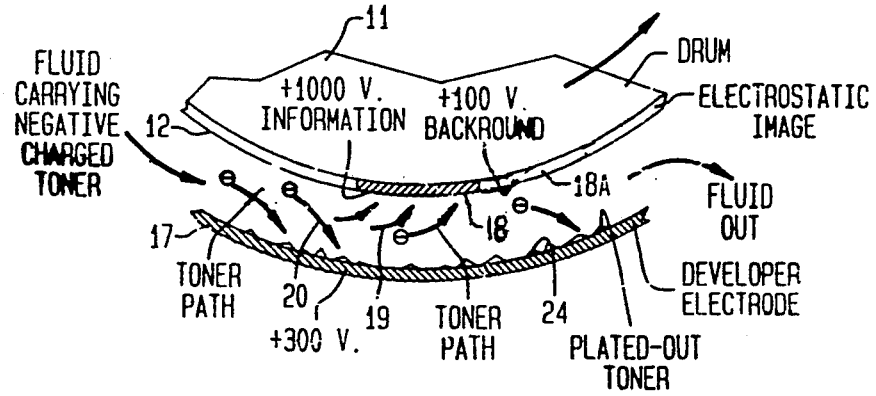
FIG. 2 is an enlarged sectional view of the drum shown in FIG. 1 associated with a developer electrode for the purpose of illustrating the manner in which plating out of toner particles on both the carrier and the developing electrode occurs.

A schematic representation of a portion of the surface of the drum containing both information and background is shown in FIG. 2, the region containing information being designated by reference numeral 18 and the region containing background being designated by reference numeral 18A. As is well known, the charged toner particles in the toner liquid located between the surface of the drum and the developer electrode are attracted to the information bearing elemental areas on the surface of the drum because the potential on these areas is greater than the potential on the electrode opposite such areas. This effect is indicated schematically in FIG. 2 by arrows 19. However, the potential on background bearing elemental areas on the surface of the drum is lower than the charge on the electrode opposite such areas with the result that toner particles are attracted to the electrode. This effect is indicated schematically in FIG. 2 by arrows 20.

As a consequence of the transfer of toner particles to the surface of the drum, and the movement of the drum relative to the electrode though a predetermined angular displacement, the electrostatic latent image is developed into an image made visible by the presence of toner particles adhering to the surface, and the developer electrode is coated with toner.

Continued rotation of the drum causes the developed image to pass metering station 21 the purpose of which is to remove excess carrier liquid from image and background areas of the image, and then to reach transfer station 22. At station 22, transfer sheet 23 is brought into contact with the surface of the drum and the developed image is transferred from the surface of the drum to the sheet in a known manner. Any toner particles remaining on the drum surface are removed at cleaning station 24 before the drum surface returns to charging station 13 completing a cycle of operation.

The apparatus described above is entirely conventional and is a simplified representation of a liquid toner electrophotographic copying machine, details of which are shown in the patents whose disclosures are incorporated by reference. For example, the invention is applicable to carriers other than drums (e.g., belts), to mechanisms for applying liquid toner other than what is shown schematically in the drawings, to metering other than reverse roller metering, to transfer station configurations other than that shown in the drawings, and to other types of electrostatic imaging machines such as printers utilizing electrostatic masters and laser printers.

The problem with such apparatus is illustrated schematically in FIG. 2 where reference numeral 24 represents toner particles that coat electrode 17 during the developing process effected at station 15. As is well known, particles 24 tend to stick to the electrode even when the developing process utilizes flowing toner liquid. Eventually, the build-up of toner on the electrode seriously affects image quality on the transfer sheet.

Figure 3:
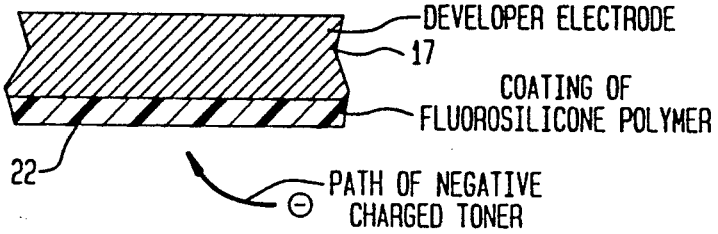
FIG. 3 is an enlarged view in section of the developing electrode according to one embodiment of the present invention.
Figure 4:
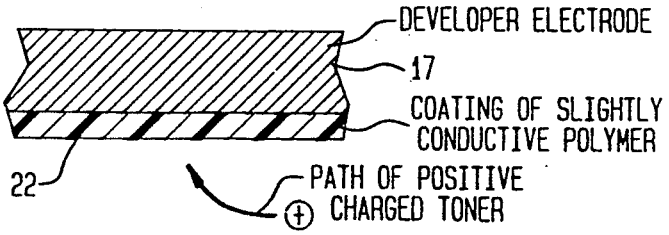
FIG. 4 is a further embodiment of a developing electrode according to the present invention.

According to the present invention, as illustrated schematically in FIGS. 3 and 4, electrode 17 is provided with inhibiting means for inhibiting the deposition of toner particles on surface 12 of the drum during the time that the latent image is being developed, i.e., during the time the surface of the drum containing the latent image is operatively associated with the developer electrode of the development station. The inhibiting means may be a layer of release material on the surface of the electrode facing surface 12 of drum 11 in the form of dielectric coating 22. Preferably the coating should be incapable of holding a surface charge at a polarity opposite to the polarity of the toner. Thus an electronegative coating should be used for negatively charged toner and an electropositive material should be used for positive toner. When the charge on the toner is negative, the preferred coating is a fluorosilicone polymer, for example, Dow Corning 730 Solvent Resistant Sealant. A coating thickness of about 20 microns is satisfactory, although thicknesses of less than 2 to 100 microns are also operative to inhibit plating. This material is believed to produce the desired result because it is electronegative, that is it naturally develops a negative surface charge and can not carry a positive charge. Thus, such material has an electrical disaffinity for negatively charged particles which do not stick to the material.

When the charge on the toner particles is positive or as an alternative coating when the toner particles are negatively charged, making the dielectric coating slightly conductive is advantageous. This can be achieved by an additive, such as carbon black, which causes the resistivity of the coating to be in the range of about $10^{13}$ to about $10^{10}$ ohm-cm, preferably about $10^{12}$ to $10^{11}$. The physical size of the carbon black particles should be very small to ensure uniform surface conductivity on the electrode. That is to say, the surface conductivity should be both uniform and continuous on the surface. Other polymer materials can be used for coating the electrode provided the conductivity range is as described above.

A suitable additive to the preferred fluorosilicone polymer for this purpose is Catafor CA100, a product currently produced by AMB Chemicals Ltd., Poleacre Lane, Woodley Stockport, Cheshire, England. To obtain this degree of conductivity, less than about 1% by weight of the preferred additive is used. The preferred range of additive to dielectric is about 0.5% to about 0.75% by weight. Percentages greater than about 1% by weight are less effective in inhibiting the sticking of toner particles to the electrode.

Developer electrodes made in accordance with the present invention permit copies to be made without gray scale variation in the process direction when copies are made of a uniformly gray object. This is a substantial improvement over the prior art.

EXAMPLE I

Toner liquid was prepared by mixing 1000 grams of Elvax II polymer 5720 (manufactured by DuPont Corporation) and 500 grams of Isopar L (manufactured by Exxon Corporation) in a Ross Double Planetary mixer at 90° C. After mixing for about one hour, 250 grams of carbon black (Mogul L) and 500 grams of Isopar L were added; and mixing was continued for about for about one hour at 90° C. Additional Isopar L was added to provide a mixture of 30% solids and 70% Isopar L; and mixing was continued at the same temperature for about one hour. The material was allowed to come to room temperature with continued mixing for over a period of 3 hours. The material was then diluted with Isopar H to a 13.35% by weight non-volatile solids composition, and the composition was ground with ½ inch $AL_2O_3$ cylinders in M-18 Sweco vibratory mill (approximate loading volume, 2 gallons) for about 24 hours at about 40° C. The toner concentrate was then diluted to a 1.5% non-volatiles concentration with Isopar H. Then, 0.6 grams of lecithin (a charge director) dissolved in 5.4 grams of Isopar H was added to 1500 grams of diluted toner dispersion. The toner particles in the toner dispersion were negatively charged in a conventional way to a conventional degree.

A coating of Dow Corning 730 Solvent Resistant Sealant approximately 20 microns thick was applied to half of the developer electrode on a Savin 870 copier such that half the latent image was subject to an electrode according to the invention, and half was not. The conventional back-pulsing (deplating operation) of the developer electrode of the copier was disabled, and a constant +300 V. dc bias was applied to the developer electrode. In addition, the paper feed was disabled; but because the transfer station is downstream of the developer station, this had no effect on the operation of the developer station.

In order to maximize the deposition of toner on the developer electrode, a blank, white document was copied 2,000 times. After the run was completed, the uncoated half of the electrode was found to be plated with toner particles, and the coated half was free of toner particles. At this point, the paper feed was enabled, and 100 copies of a test document were made. No discernible difference was found either between the two sides of the copies, or as a function of time. This demonstrated that the presence of a coating on the developer electrode does not adversely affect image quality while maintaining the electrode free of toner.

EXAMPLE II

The setup was the same as in EXAMPLE I, but in this case, no background runs were made. The paper feed was enabled, and 150 copies of a test document were made. No discernible difference was found between either the two sides of the document, or as a function of time.

While a specific toner liquid was used in the above examples, it is believed that the results obtained are not dependent on the specific nature of the toner liquid, and that the present invention will operate successfully with conventional liquid toners such as those described in the patents incorporated by reference. In addition, the present invention is applicable to developer electrode voltages other than strictly dc voltages. For example, the invention is applicable apparatus in which the developer electrode is unidirectional, but time variable.

The advantages and improved results furnished by the method and apparatus of the present invention are apparent from the foregoing description of the preferred embodiment of the invention. Various changes and modifications may be made without departing from the spirit and scope of the invention as described in the appended claims.

We claim:

1. A developer electrode for a liquid toner based electrophoretic imaging machine having a movable carrier carrying an electrostatic image including background and information portions, and having a developing liquid comprising charged toner particles which is applied between the carrier and the electrode for developing the image by plating out toner particles on information portions of the carrier, said electrode having a surface facing the carrier, and inhibition means on said surface for inhibiting the deposition of toner particles on said surface during development of the image, wherein said inhibition means includes a release coating on the surface of the electrode facing the carrier, said coating comprising a polymer material and a conductivity increasing additive and having a resistivity in the range of $10^{10}$ to $10^{13}$ ohm-cm.

2. An electrode according to claim 1 wherein said polymer material is a fluorosilicone polymer.

3. An electrode according to claim 2 wherein the coating has a resistivity in the range of about $10^{12}$ to $10^{11}$ ohm-cm.

4. An electrode according to claim 1 wherein said coating is between about 2 and 100 microns in thickness.

5. An electrode according to claim 1 wherein said coating includes a conductive additive which results in the coating having a resistivity in the range from about $10^{12}$ to $10^{11}$ ohm-cm.

6. A liquid toner based imaging machine comprising:

a) a movable carrier surface;

b) means for producing an electrostatic latent image on the carrier surface, said image having first and second regions with first and second respective voltages; and c) a developing station having a source of developing liquid that includes charged toner particles, said station being operatively associated with the carrier for contacting the carrier with said liquid thereby developing the latent image by effecting the transfer of toner particles to said image;

said developing station including:

(1) a developer electrode charged to a voltage intermediate said first and second voltages on the carrier for attracting particles to said first regions; and (2) inhibiting means for inhibiting the deposition of toner particles on the surface of the electrode during the development of the image, said inhibiting means including release coating on the surface of the electrode facing the carrier, said coating comprises a polymer material and a conductivity increasing additive and has a resistivity in the range of $10^{10}$ to $10^{13}$ ohm-cm.

7. A machine according to claim 6 wherein the resistivity of the release coating is in the range of $10^{11}$ to $10^{12}$ ohm-cm.

8. A machine according to claim 6 wherein said polymer material includes a fluorosilicone polymer.

9. A machine according to claim 8 wherein said additive is less than about 1% by weight.

10. A liquid toner based imaging machine comprising:

a) a movable carrier surface;

b) means for producing an electrostatic latent image on the carrier surface, said image having first and second regions with first and second respective voltages; and c) a developing station having a source of developing liquid that includes charged toner particles, said station being operatively associated with the carrier for contacting the carrier with said liquid thereby developing the latent image by effecting the transfer of toner particles to said image;

said developing station including:

(1) a developer electrode charged to a voltage intermediate said first and second voltages on the carrier for attracting particles to said first regions; and (2) inhibiting means for inhibiting the deposition of toner particles on the surface of the electrode during the development of the image, said inhibiting means including release coating on the surface of the electrode facing the carrier, said coating comprising a polymer material and a conductivity increasing additive wherein said additive is less than about 1% by weight of said release coating.

11. A machine according to claim 10 wherein said material includes a fluorosilicone polymer.

12. A machine according to claim 3 wherein said coating is between about 2 and 100 microns in thickness.

13. A machine according to claim 12 wherein said coating is about 20 microns in thickness.

14. A machine according to claim 10 wherein the resistivity of the coating is in the range of about $10^{12}$ to $10^{11}$ ohm-cm.

15. A machine according to claim 14 wherein said material includes a fluorosilicone polymer.

16. A method for electrophotography comprising the steps of:

a) forming on a movable carrier an electrostatic image having first and second regions with first and second voltages respectively;

b) moving the carrier into proximity with a developer electrode held at a voltage intermediate said first voltages and second voltages;

c) applying liquid toner containing charged toner particles between the carrier and the developer electrode for plating out toner particles on first portions of the carrier; and d) suppressing the plating out of toner particles on the electrode while the toner liquid is applied between the carrier and the developer electrode by coating a release material on the surface thereof facing the carrier, said material comprising a polymer material and a conductivity increasing additive and having a resistivity in the range of $10^{10}$ to $10^{13}$ ohm-cm.

17. A method according to claim 16 wherein said polymer material comprises a fluorosilicone polymer.

18. A method according to claim 16 wherein the resistivity of the release material is in the range of about $10^{12}$ to $10^{11}$ ohm-cm.

19. A method according to claim 18 wherein said polymer material includes a fluorosilicone polymer.

* * * * *